United States Patent [19]

Gomori

[11] 4,065,128

[45] Dec. 27, 1977

[54] ELECTRONIC TABLE SOCCER GAME

[76] Inventor: Alexandre Gomori, 10-12, Rue Arnold Van Gennep, Bourg-la-Reine, France

[21] Appl. No.: 632,831

[22] Filed: Nov. 17, 1975

[51] Int. Cl.[2] ..... A63F 7/06

[52] U.S. Cl. ..... 273/85 D

[58] Field of Search ..... 273/85, 86 C, 110; 16/87.8; 242/75.3

[56] References Cited

U.S. PATENT DOCUMENTS

| | | | |
|---|---|---|---|
| 588,988 | 8/1897 | Harrington | 273/86 C |
| 745,240 | 11/1903 | Rolland | 242/75.3 |
| 1,468,839 | 9/1923 | Sheehan | 242/75.3 X |
| 1,998,453 | 4/1935 | Foster et al. | 242/75.3 X |
| 2,320,003 | 5/1943 | Madan | 16/87.8 |
| 2,872,193 | 2/1959 | Hamilton | 273/119 A |
| 3,315,297 | 4/1967 | Bender | 16/87.8 |
| 3,554,547 | 1/1971 | Vedeen et al. | 273/85 B |
| 3,815,917 | 6/1974 | Brown | 273/110 |

FOREIGN PATENT DOCUMENTS

| | | | |
|---|---|---|---|
| 1,012,694 | 4/1952 | France | 273/85 D |
| 686,961 | 3/1965 | Italy | 273/85 D |
| 615,197 | 6/1961 | Italy | 273/85 C |
| 167,540 | 5/1934 | Switzerland | 273/85 D |

*Primary Examiner*—Anton O. Oechsle
*Attorney, Agent, or Firm*—Holman & Stern

[57] ABSTRACT

Disclosed is a game of table soccer or the like in which rows of figurines oppose each other and whose movements are controlled by one or more players. A combination of movement translators, friction reducers, shock absorbers and electronic "shooters" ensure ease of operation and long operational life.

7 Claims, 13 Drawing Figures

ELECTRONIC TABLE SOCCER GAME

BACKGROUND OF THE INVENTION

The present invention concerns a game of skill, such as a table soccer or hockey game or the like, representing movements and analogous characteristics, which comprises figurine-carrying tubes on which figures, constituting the players, are attached to form two teams which are disposed face to face and transversely on the game table in multiple rows. The tubes carrying the figurines slide on rail supports, the tube movement being caused by the players of the game moving control handles which are disposed at two ends of the table. Transmitting means between each control handle and the corresponding figurines carrying tubes are set up on horizontal shafts which are longitudinally disposed relative to the table, and tied by flexible cords or cables to the figurine-carrying tubes. Rotational movement of the rail supports causing a shooting movement by the figurines for hitting the game-ball or, for example, in case of hockey, for hitting a smooth disk, in preference to only one by game, are instituted by means of one or a plurality of electro-magnets per team. These electro-magnets are controlled by means of push buttons which are advantageously incorporated in the control handles for transverse movements. The electro-magnets operate on the joined radial lever arms of the rail support forcing the figurines into a shooting movement. The lever arms can be connected to a rod or a cable comprising an elastic or a band of rubber, or more advantageously, a rubber-extensible return spring, such that after the "shoot", the arms return to their original position.

A first objective of the instant invention consists in the fact that this arrangement comprises a mechanism for transformation of the circular movements of the control handle into rectilinear movements applied to the figures-carrying tubes.

A second objective of the instant invention constitutes the provision of a restricting or limiting device of the course of travel of the control handles.

A third objective of the present invention concerns the provision of device in order to reduce the friction between the figure-carrying tubes and their support rails.

A fourth objective of the present invention relates to the provision of a cord or cable stretcher which absorbs sudden stops shocks or jerks so that the impact of the transmission of movements is absorbed when strong movements are applied to the control handles during the course of the game.

A fifth objective of the present invention resides in the provision of a system permitting at least one of the teams of the figures to shoot without the intervention of players who are physical persons in the game, thus providing a regular team-robot which is able to play against the other team which is controlled by one or two players who are physical persons, the novelty residing in that in this type of game, one person alone can play the game.

A sixth objective of the present invention concerns and is relative to the provision of electronic means of controlling the starting gear of the "shoots" and the bringing of the ball of the game into play again after each goal.

A seventh objective of the present invention concerns and is relative to the provision of photo-electric means of controlling the throw-in of the ball on the playing field and of the counting of goals, or scoring of the goals.

BRIEF DESCRIPTION OF THE DRAWINGS

Further embodiments disclosed in the specification are explained hereinbelow, and are illustrated in the accompanying drawings, wherein.

DETAILED DESCRIPTION OF A PREFERRED EMBODIMENT

A primary objective of the present invention is to transform, or change, the circular movement of the control handles into a rectilinear movement applied to the figurine-carrying tubes.

Figure 1:
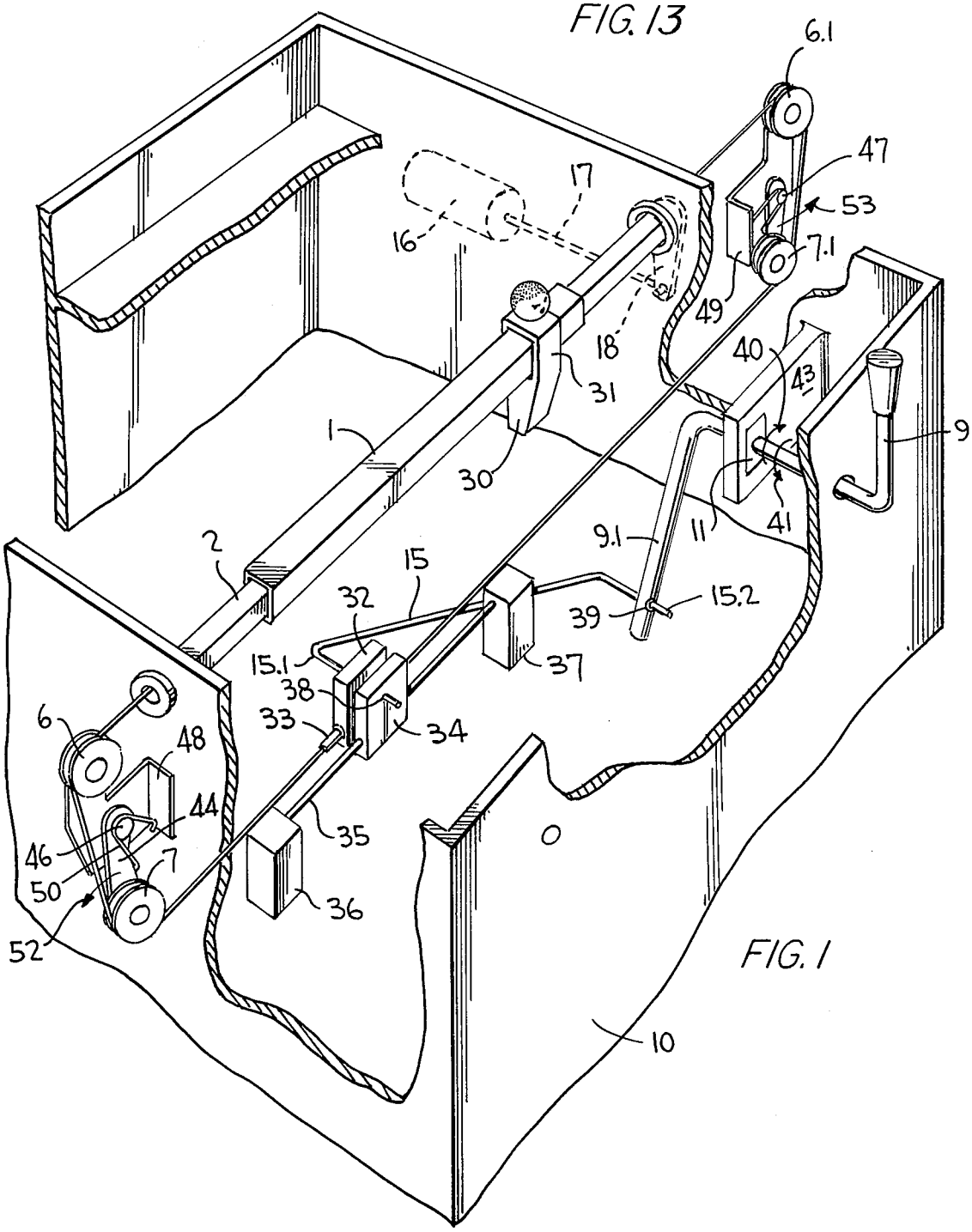
FIG. 1 illustrates a perspective view of an upper portion of the apparatus with sections broken away to permit a view of the control gear with its course-limiting means and a device for stretching the cord or cable, permitting the absorption of sudden jolts.

As seen in FIG. 1, the table 10 of the apparatus supports eight transverse rails 2 of which only one is shown in the drawing for purposes of simplification.

On the rails 2 slides the figurine-carrying tube 1 supporting the figurines 30 of which represent the teams. The operation for rotation of the rails 2 to bring about a "shoot" is effected by means of electro-magnet 16 controlling the rails 2 by means of a rod 17 which acts on a lever arm 18 locked to the rail's support. The electro-magnets (solenoid 16) are controlled by means of push buttons which are being advantageously incorporated in the control handles for transverse movement. The rails 2 enclose a cord or cable 5 preferably consisting of a material which is flexible and non-extensible. The figurines 30 are fixedly attached to the tube 1 by any appropriate means, for example, by screws 31 or by glueing, or simply by facing them on the figurines-carrying tubes, with cross-pieces between each figurine, and immobilizers at two figurine-carrying end by the sliding-short-sleeve. The cords or cables 5 are fixed to the ends of the tubes 1 also by any appropriate means. The cord or cable 5 winds up on four return-pulleys 6, 6-1, 7, and 7-1. After having traversed through a slide block 32 the cable is secured by metallic tips fixed 33 on the extremity of the cord or cable, preventing removal from the slide block 32. In front of the slide block 32 there is located a counter-slide-block 34 which shifts itself on a guide comprising a rigid rectilinear rod 35 parallel with the cord or cable 5 and fixed on two integral blocks 36 and 37 of the table 10 or on two metallic supports fixed on the bottom of the upper portion of the table.

A simple crank arm 15 constituted by a metallic elbow rod of U-shape at its two ends 15-1 and 15-2 connects elbow end 9-1 to slide block 32. One end 15-1 is inserted into two holes placed so that one is facing the other in the slide-block 32 and in the counter-slide-block 34. The other end 15-2 of the crank arm 15 penetrates a hole in the elbow end 9-1 of the control shaft 9. Two clamps (or clips) 38 and 39 retain the crank-arm in its position.

The control shaft 9 pivots in the direction of arrows 40 and 41 in a pillow-block 42 of the wall in front of the table 10 and in a further pillow-block 43 on a support attached on said table 10.

The apparatus operates in the following fashion: the movements of the control shaft 9 in the direction of arrows 40 and 41, pull or push on the crank arm 15 with the bent end 15-1 displacing slide-block 32 and counter-slide-block. The movement is rectilinear and parallel to the cord or cable 5, the direction of movement being fexed by the rigid rod 35 forming the guide. This rectilinear movement is transmitted to cable 5 by the slide-block 32 and, thereby, to the figurines-carrying tube 1. Any change in the position of the cord or cable results in the movement of the tube 1 and slide-block 32 and therefore is very smooth.

The drawing shows, for purposes of simplification only, a single control shaft 9. However, it is well known that a plurality of shafts 9 are to be placed side-by-side for moving all the figurine-carrying tubes 1 of the game.

Figure 2:
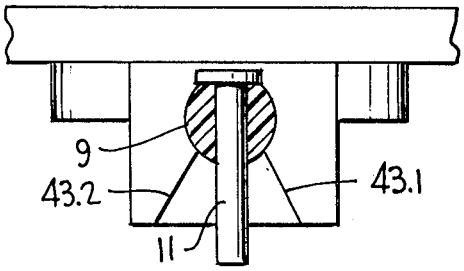
FIG. 2 shows the course-limiting means, shock absorber, or dead-end device, of the control handle.
Figure 3:
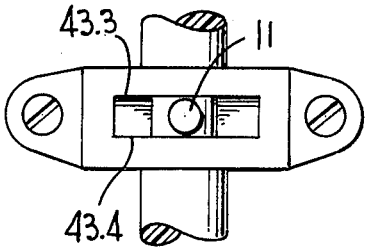
FIG. 3 is a view as in FIG. 1 of the course-limiting means, dead-end or damping device, as detailed in FIG. 2.

The second embodiment of the present invention comprises a course-limiting means dead-end device to limit the course of travel of the control handle. A stop bolt 11, preferably made of a tough or hardened steel, is rigidly locked with the control shaft 9, at the spot where the shaft traverses the pillow-block 43. FIG. 2 shows the pillow-block, preferably consisting of an adequate plastic material, with inclined facings 43-1 and 43-2 limiting the circular movements in the direction of arrows 40 and 41 of the stop bolt 1 and therewith limiting the movements of the control shaft 9 with which it is rigidly locked. The pillow-block 43 may be rigid and comprises two further flanges 43-3 and 43-4 limiting the lingitudinal displacement of the stay bolt 11 of FIG. 3 and thereby the control shaft 9 with which it is rigidly locked and thus retained in that longitudinal position. The course-limiting means-damping device of the shaft deadens the shocks provoked by the players in case of brutal movements before the figurine-carrying tube arrives at the end of its travel and so the physical efforts of the players cannot be transmitted to the flexible cables or to the lateral walls of the table. It suffices to utilize an adequate length of the flexible cable so that the figure-carrying tubes do not touch the end of the transverse course of the walls of that table.

A third embodiment of the present invention concerns the device for reducing the friction between each tube carrying the figurines and its rail, which may cause wear or jammings, or simply an excessive effort of movement. For the purpose of preventing such disadvantages, the insertion, on the horizontal upper portion of the two ends of the tube carrying the figurines, of a piece of plastic material or an anti-friction metal will avoid a direct contact between that portion with the metallic rail.

Two forms of friction reduction are proposed towards that end:

The first method is the insertion of pieces of plastic material or metallic anti-friction material having for example the form of a rivet which is applied at least on the two upper horizontal ends of the figurines-carrying tube by making in these two ends a hole of a diameter corresponding with the shaft of the rivet and by pushing that rivet into the tube carrying the figurines, into the hole, for the purpose of confinement thusly between that figurine-carrying tube and its rail support. Thus, the tube carrying the figurines never touches its rail support, but the head of the rivet of a plastic material or of an anti-friction metal which interposes between the same, allowing smooth sliding between the metallic rail support and the two heads of rivet of plastic material or of an anti-friction metal.

It is evidently possible to equally apply these same rivets of plastic material or anti-friction metal on the two vertical sides of the figurine-carrying tube, thus preventing a direct contact of the metallic sides with the vertical metallic sides of the rail support.

Figure 4:
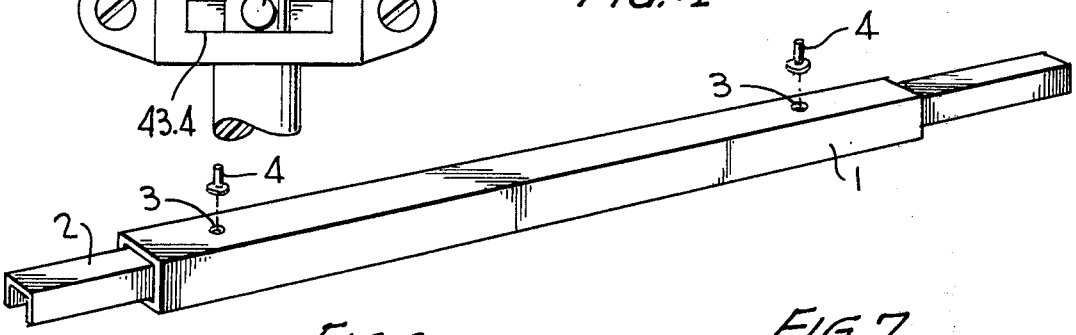
FIG. 4 illustrates a figurine-carrying tube mounted on its rail support with friction rivets between the tube and its rail.

FIG. 4 is a perspective view of a figurine-carrying tube 1, having on its two horizontal ends a hole 3 into which a rivet of plastic material or of an anti-friction metal 4 is introduced, the latter being confined between the figurine-carrying tube 1 and its rail support 2.

Figure 5:
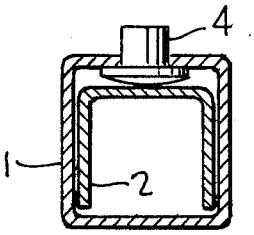
FIG. 5 represents a cross-section of the figurine-carrying tube and of its rail, and the axial cross-section of one of the friction rivets of FIG. 4.

FIG. 5 is a sectional view of the same assembly wherein numeral 1 denotes the tube carrying the figurines and numeral 4 represents the rivet of plastic material or of an anti-friction metal and numeral 2 is the rail support.

The second method of the third embodiment of the present invention concerns a sliding-short-sleeve of plastic material or an anti-friction metal, which is introduced on the two ends of the figurine-carrying tubes and which extends these ends by some millimeters. That portion passing the figurines-carrying tube possesses at the inside, at its upper horizontal side, but preferably also on its two vertical sides, a thickness (or depth) which is adequate to cooperate with the corresponding sides of the rail support. The portion of the short-sleeve which touches the rail is convex so that it reduces the surface of contact between the two pieces and in the same way reduces the friction, and produces a very smooth sliding between the sliding short-sleeve of plastic material or of an anti-friction metal and its rail support.

The tube carrying the figurines never touches the rail support, being suspended between two slide-short-sleeves. Thus, one may choose for the tube carrying the figurines any sort of metal; even one which is the least onerous, for example, ordinary aluminum as it does to never touch the rail support at least of its upper horizontal portion. Moreover, in case of wear, it is always much less burdensome to change a relatively small slide-short-sleeve of plastic material or of an anti-friction metal, than the figurines-carrying tube and its rail support, sliding up to one another on the entire surface of the figurines carrying tube.

Figure 6:
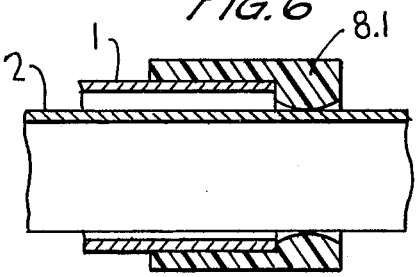
FIG. 6 represents a longitundinal cross-section of the figurine-carrying tube and its rail, showing a section of the friction means mounted at the end of the figurine-carrying tube.

FIG. 6 is a detailed view of the slide-short-sleeve 8, mounted on the tube carrying the figurines 1 and with the portion 8-1 passing the latter, resting its convex face on the rail support 2.

Figure 7:
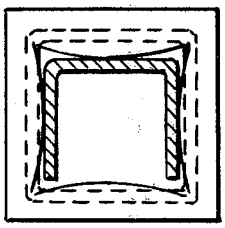
FIG. 7 is a bottom view of the portion of FIG. 6, seen in the sense of FIG. 2.

FIG. 7 is a section of the same set where 8 is the slide-short-sleeve mounted on the figure-carrying tube 1, the short-sleeve being in contact with the rail support 2.

The fourth embodiment of the present invention is relative to a cord or cable stretcher absorbing the jolts, or sudden stoppages such as when transverse figurines movements are made. That device maintains under all circumstances the optimum tension on the cord or cable 5, however great the speed of the transverse movements which may be applied by the players of the game, thus preventing the cord or cable from jumping off the grooved-pulleys. It comprises a number of pulleys 7 and 7-1 (FIGS. 1 to 8) on the lever arms 44 and 45 pivotally mounted on pivots indicated by 46 and 47 on the fixed supports 48 and 49 of the pulleys 6 and 6-1. The pin springs 50 and 51 (resilient pins) centered on the pivots 46 and 47 are supported on one hand on the fixed supports stays 48 and 49, on the other hand on the levers 44 and 45, for the purpose of exercising on the levers a pair of constant rotations in the direction of arrows 52 and 53, which always maintains the same tension on the cord or cable 5. The discussed parts are clearly shown in FIG. 8 which shows the lateral wall 10-1 of the table 10 on which is mounted or pressed a fixed support stay 49 carrying the pulley 6-1 on the pivot 47 articulates the levier 45 which is carrier of the pulley 7-1. The cable rolls up onto the pulley and its constant tension is assured by means of the pin spring 51. If, for one reason or other, some of the cord or cable 5 loosens or slackens the pulley 7-1 comes, for example, at 7-2, the tension of the cord or cable is maintained constant due to a torque 53 produced by the pin spring 51.

Figure 8:
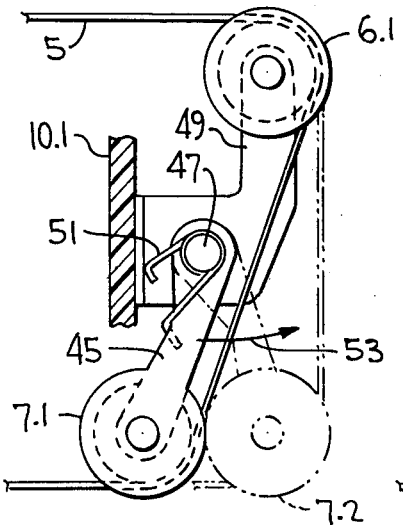
FIG. 8 illustrates a cord or cable-stretching device, in a first embodiment.
Figure 12:
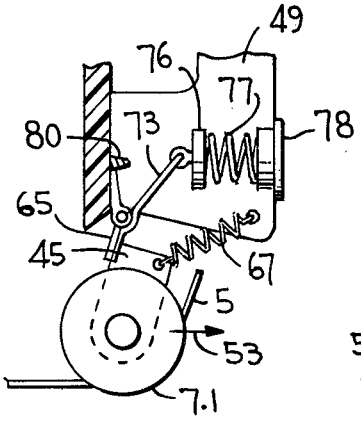
FIG. 12 is a variant of the cord or cable-stretching device for absorbing shocks or sudden stops, as in FIG. 8.

FIG. 12 shows a variant of the embodiment shown in FIG. 8. The pulley 7-1 is mounted on a pivotal lever 45, hinged not on pivot 47 but by one hinge 55 of steel, wherein the axis is of a copper-metal of the toughness of a phosphorous or analogous bronze of the type avoiding jamming. A traction element 67 is attached at one hand to the fixed support 49 and on the other hand to a pivotal lever 45. This traction element tends to pivot the lever 45 in the direction of arrow 53 and thus maintain a constant tension on the cord or cable 5. The element 67 may comprise a metallic spring operating in tension which incorporates the attaching of the ends. It may perhaps constitute a rubber strap or, more advantageously, a "rubber-extensible spring". It may comprise an elastic band such as a compression element 77, active on an extension means 73 of lever arm 45, the extension having an end portion which is rolled in the form of a hollow cylinder receiving an axis onto which is welded the pressed or turned guide 76 which cooperates with one end of the element, the guide 78 of the other end of element 77 being fixedly attached to the fixed support 49. These two guides of said element can equally be mounted at knee joint on the extension of the lever arm on one hand and on the fixed support on the other hand. In order to limit the course of the pivoting lever 45 in the sense seen at 53, a stop means 80 is provided.

Figure 9:
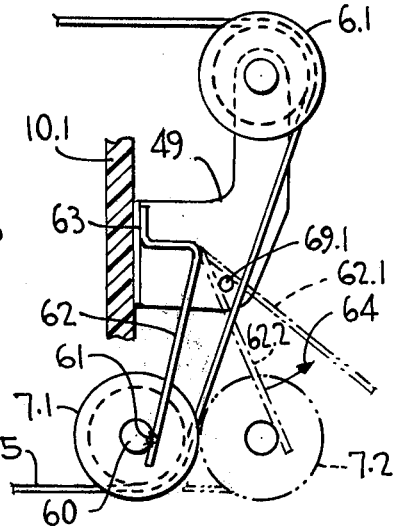
FIG. 9 illustrates another embodiment of the cable-stretching device.

In a further embodiment of this mechanism, against sudden jolts, henceforth a constant tension of the cord or cable, the pulleys 7 and 7-1 are mounted loosely on the axles which are seen at 60 in FIG. 9. These axles are fixed by any appropriate means and, preferably, are welded electrically at 61 at the end of a metal element 62 which end being in the form of a fork permitting the pulley 7-1 to pass.

The other end of the metal element 62 is fixed at 63 on the lateral divider wall 10-1 of table 10, at the same time that the fixed support 49 carries the pulleys 6 and 6-1. The form of the metal element 62 is established with a plurality of braces in a manner to provide the maximum of smoothness and for the trajectory of pulleys 7-1 at 7-2, whereby the position of the same is made not to vary in the direction of the horizontal shoot of the cord or cable 5 by means of a mechanical stop 69-1.

The initial form of the curvature 62-1 of the plate 62 is such that in the position of operation 62 and 62-2, cable 5 in place, a tension in the direction of arrow 64 is constantly applied to the cord or cable 5.

A fifth embodiment of the invention resides in a system permitting at least one of the team of figurines to shoot without interference of players who are physical persons, which is providing thus a veritable robot-team against the other team, controlled by one or two players who are physical persons.

The novelty consists in that in this game one person can play the game by himself.

The robot system comprises by combination of two elements, that:

1. A system in which the figurines are made to "shoot" by means of an automatic device, without intervention of players who are physical persons, at certain intervals, by automatic impulses for one or more electro-magnets of the equipment in question.

2. A playing field in appropriate relief which prevents the ball of the game from coming to rest in certain positions, thus provoking the stopping of the game.

The characteristics of this setting of action of the invention is being disclosed hereinbelow.

The system which enables, to "shoot" by one of the team of figurines, alternatively by the impulses initiated by the manual contacts or are automatically initiated. It calls for the approach of a commutator. The same, when in one of these positions, allows to use all the push buttons of the two teams which are located at the two ends of the game table, in order to provide manually the impulses to two or more electro-magnets 16 of the two teams. The same commutator, in the second position, distributes the current in known electrical or electronic systems in a fashion adequate enough to send automatically, during the required period, and in an intermitted manner, the impulses to one or more electro-magnets 16 of one of the teams, thus initiating automatically a shooting action by the figurines of this so signaled team robot.

In the following are given samples describing two different systems of generating the electrical or electronic impulses, which may be utilized:

1. An electric motor in which the shaft is equipped with at least one cam which moves a contact element either mechanically or automatically, sending thus a certain number of impulses at certain predetermined intervals, according to the speed of the motor or the number of the cams, preferably 40 to 60 per minute, to the electro-magnets 16 of the "team-robot" by the intermediary of electric or electronic controls.

2. A multi-vibrator electronic astable flip-flop, which initiates the impulses automatically excited at regulated intervals, one or more of electro-magnets of the "team-robot".

To prevent the inconvenience resulting from the ball's stopping in the playing field of the team-robot at a spot where it cannot be approached by a robot-figurine, occasionally stopping play, the playing field of is of an appropriate relief.

Figure 11:
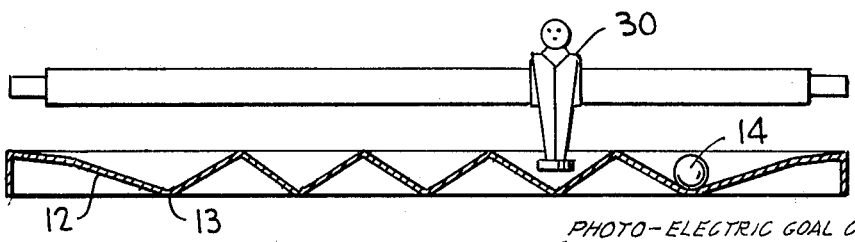
FIG. 11 is a cut along the line 11—11 of the playing field of FIG. 10.
Figure 10:
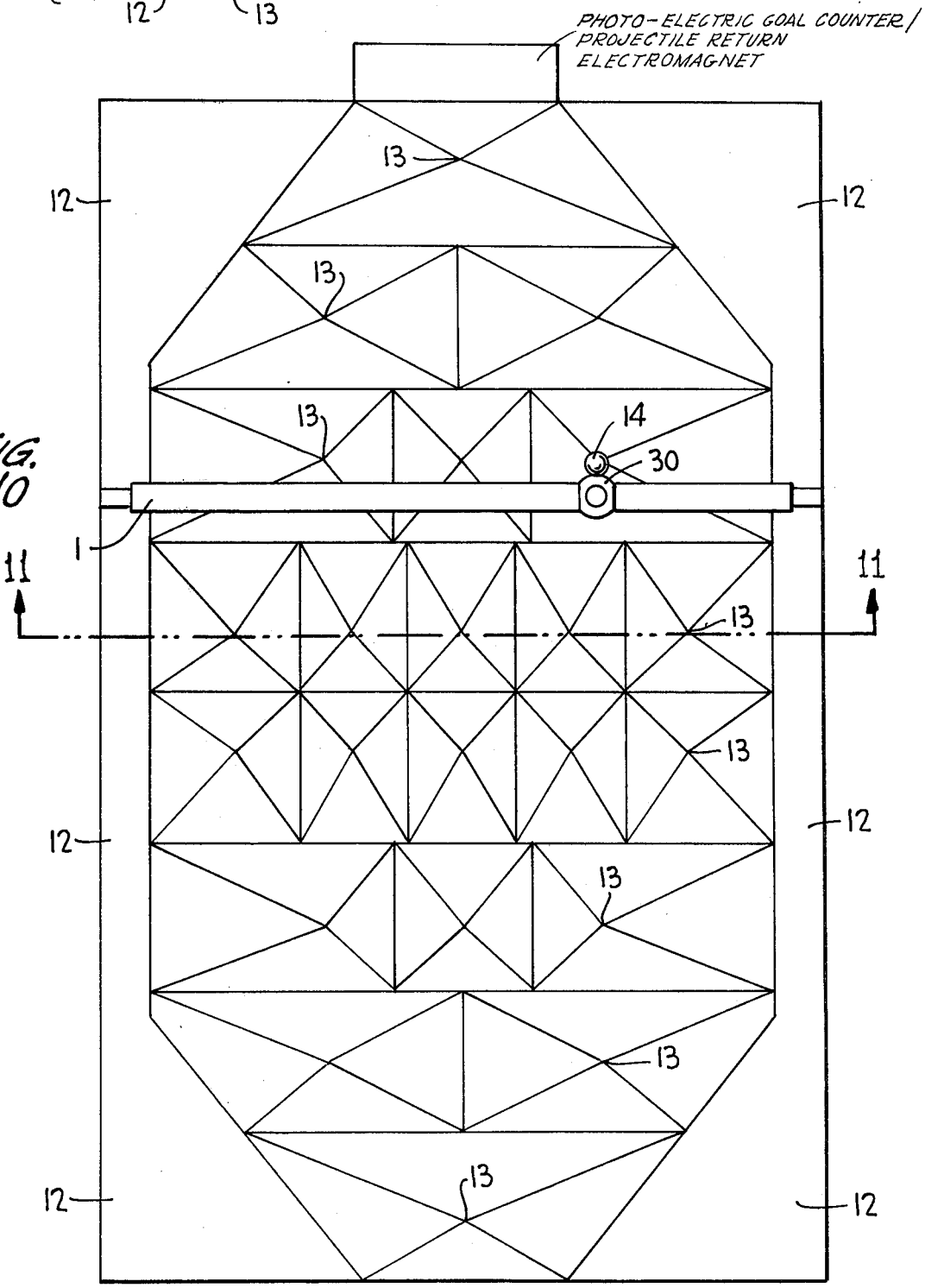
FIG. 10 represents a view of the playing field of the apparatus.

FIG. 10 shows a plan view and FIG. 11 a cut-away portion of the field. The latter comprises the inclines 12 and the hollows 13 of the type that the ball 14 of the game is directed in one of the very deep hollows 13, the latter being situated in front of the foot of the figurines 30, the figurine-carrying tubes of the team-robot being at that time centered at the start of the game. The figurines 30 of the team-robot can thus shoot automatically the ball 14.

It is understood that the side of the non-robot field is to have the symmetric form such as that of the robot side in order to assure the same chances to the players as in the case for the two teams of players who are physical persons.

Figure 13:
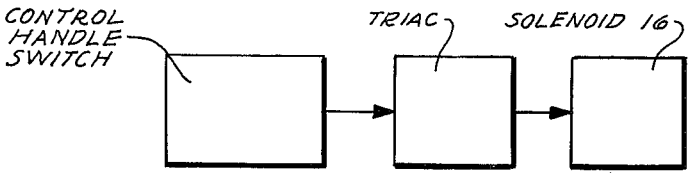
FIG. 13 is a block diagram of the electronic shooting circuit.

The sixth embodiment of the present invention concerns a static electronic mechanism for instituting the "shoot". In this case, the commutation is obtained by employing in the control circuits of the electro-magnets, static elements known by the trade name of "Triacs", an assembly of two thyristors in parallel position inverted with a single trigger. One prevents by this means all electro-mechanical instruments causing a dangerous failure to the assembly. See FIG. 13 for the block diagram of the solenoid control.

A seventh embodiment concerns the ball thrower and the counting of the goals by means of a photoelectric control device.

In the case of the projected ball, before the ball is set in play, it passes through a light beam providing a signal from a photo-electric cell, which receives that beam, which signal initiates the projection of the ball.

An electro-magnet, fixed in a vertically positioned passage, projects the ball from the passage in which it returns after each goal, to the game field.

In the same manner, but for the purpose of counting the goals, there is provided another beam such that when the ball activates the counting instrument of the marked goals and the integrated circuits which posts the number of the marked goals. FIG. 10 incorporates a block diagram showing the above described photo-electric goal counter and ball return electromagnet.

The present invention may be utilized for other games by modifying the relief and the track of the field and the number of figurines, for example, for rugby or for cricket, and may be utilized as a "pay-as-you-play" game (coin-operated or slot machine) as well as a game constituting a plaything.

The different embodiments of the present invention are described in the disclosure hereinabove and in the attached drawings which are subject to many modifications, obvious to those skilled in the art in view of the applicant's disclosure. For example, the modifications of the apparatus of the system for transforming the circular movements to rectilinear movements, or the modification of the system for checking or stopping the circular movements, or the described anti-friction devices can utilize ballbearings. Modifications to the system for constant tensioning of the cord or cable can be made such as utilizing a separate stretcher or one of the stretchers described but could be fixed on the autonomous supports located on the side or bottom of the table, etc. Many such modifications can be made without departing from the spirit or scope of the present invention.

What is claimed is:

1. In a table game, such as soccer, hockey or the like, including a playing field with goals at either end, across which are arranged a plurality of rows of controllable figurines for maneuvering a ball or disk across said playing field and into an opponent's goal, said game further including means for slidably mounting said rows of figurines on a mounting support bridging side walls of the playing field such that the transverse location of said figurines is mechanically adjustable through control handles operable by players of the game at opposite ends of the playing field, said rows of figurines each further adapted such that, through rotation of the mounting support in response to the operation of a solenoid, the figurines are rotated about a horizontal axis with the lower portion of one of said figurines contacting said ball or disk and propelling said ball or disk in longitudinal directions along said playing field, said solenoid being operable in response to a player closing a switch on the control handle and biased such that after said rotation, the solenoid and figurines return to a vertical orientation, said improvement in said game comprising:

means for transforming circular movements of each of said control handles into rectilinear movements and for applying said rectilinear movements to a row of figurines;

restrictor means for limiting rotational movement of said control handles;

photoelectric control means for counting the number of times said ball or disk is propelled into an opponent's goal; and means for automatically returning said ball or disk to said playing field after a goal is scored.

2. The table game of claim 1, wherein said means for slidably mounting said rows of figurines comprises a structure slidably mounted on said mounting support, said structure mechanically connected to said means for transforming.

3. The table game of claim 2, wherein said means of transforming comprises:

cable means for forming a closed loop of flexible cable a portion of said loop passing adjacent and parallel to said means for slidably mounting;

pulley means for maintaining a portion of said cable means adjacent and parallel to said means for slidably mounting; and connecting means for connecting said control handle with said cable means, including guide means for insuring rectilinear motion adjacent and parallel to a further portion of said cable means, said connecting means further including linkage connecting said control handle to said guide means.

4. The table game of claim 3 wherein said guide means includes; at least two fixed supports supporting a rigid rod therebetween, said rod parallel to said further portion of said cable means; a guide block means slidably disposed on said rigid rod and fixably connected to said further portion of said cable means; and said linkage comprises a U-shaped rod having two ends, one of which is rotatably mounted in said guide block means, the other end is rotatably mounted in said control handle.

5. The table game of claim 2 wherein said control handles rotate about control shafts disposed in the longitudinal direction and said restrictor means comprises:

pillow block means fixably mounted in said table game through which said control shaft is mounted; and stop means fixably connected to said control shaft and extending radially way from said shaft, said pillow block means including an aperture through which said stop means extends, said aperture including interior walls for limiting movement of said stop means and, through said control shaft, for limiting movement of said control handle in the rotational and longitudinal directions and limiting transverse movement of said rows of figurines.

6. The table game of claim 1 wherein said solenoid is operable through an electric pulse from a "Triac" triggered by said control handle switch.

7. The table game of claim 1 wherein said photoelectric control means comprises:

means for generating a light beam through which said ball or disk must pass when a goal is scored;

light sensing means for providing an electrical signal when said light beam is interrupted; and means for counting and displaying the goals scored when playing said table game.

* * * * *